United States Patent [19]

Knaack et al.

[11] Patent Number: 4,953,829

[45] Date of Patent: Sep. 4, 1990

[54] FASTENING A CABLE OR A DRUM

[75] Inventors: Karl Knaack, Dortmund; Rainier Horbach, Witten, both of Fed. Rep. of Germany

[73] Assignee: Mannesmann AG, Duesseldorf, Fed. Rep. of Germany

[21] Appl. No.: 57,957

[22] Filed: Jun. 3, 1987

[30] Foreign Application Priority Data

Jun. 4, 1986 [DE] Fed. Rep. of Germany ..... 3618759
Mar. 12, 1987 [DE] Fed. Rep. of Germany ..... 3708212

[51] Int. Cl.[5] ..... B66D 1/34; B66D 1/35

[52] U.S. Cl. ..... 254/333; 254/DIG. 14; 242/117

[58] Field of Search ..... 254/333, 374, 383, DIG. 14; 242/77.3, 77.4, 125.1, 125, 117

[56] References Cited

U.S. PATENT DOCUMENTS

| | | | |
|---|---|---|---|
| 823,401 | 6/1906 | Ferris | 242/125.1 |
| 2,438,515 | 3/1948 | Mohler | 242/125 X |
| 2,584,099 | 1/1952 | Harkrader | 242/117 |
| 2,846,162 | 8/1958 | Allin | 242/117 X |
| 2,966,338 | 12/1960 | Simons | 254/383 X |
| 3,048,370 | 8/1962 | Kratzer | 254/333 X |
| 3,807,697 | 4/1974 | Cotreau | 254/383 X |
| 3,836,123 | 9/1974 | Bausenbach | 254/333 X |
| 4,005,852 | 2/1977 | Schmitmeyer | 254/383 X |
| 4,519,556 | 5/1985 | Timoschuck | 242/117 |

FOREIGN PATENT DOCUMENTS

| | | | |
|---|---|---|---|
| 2718498 | 11/1978 | Fed. Rep. of Germany | 254/383 |

*Primary Examiner*—Katherine A. Matecki
*Attorney, Agent, or Firm*—Ralf H. Siegemund

[57] ABSTRACT

An end face of the cable drum is provided with a straight groove into which the cable end is clamped either directly by screws or by a screw fastened holding block. The groove merges through curved portions on one or both ends with a cable receiving grooves on the drum's periphery. A two arm cable guide or a cable hold down device is provided.

11 Claims, 2 Drawing Sheets

Fig.1
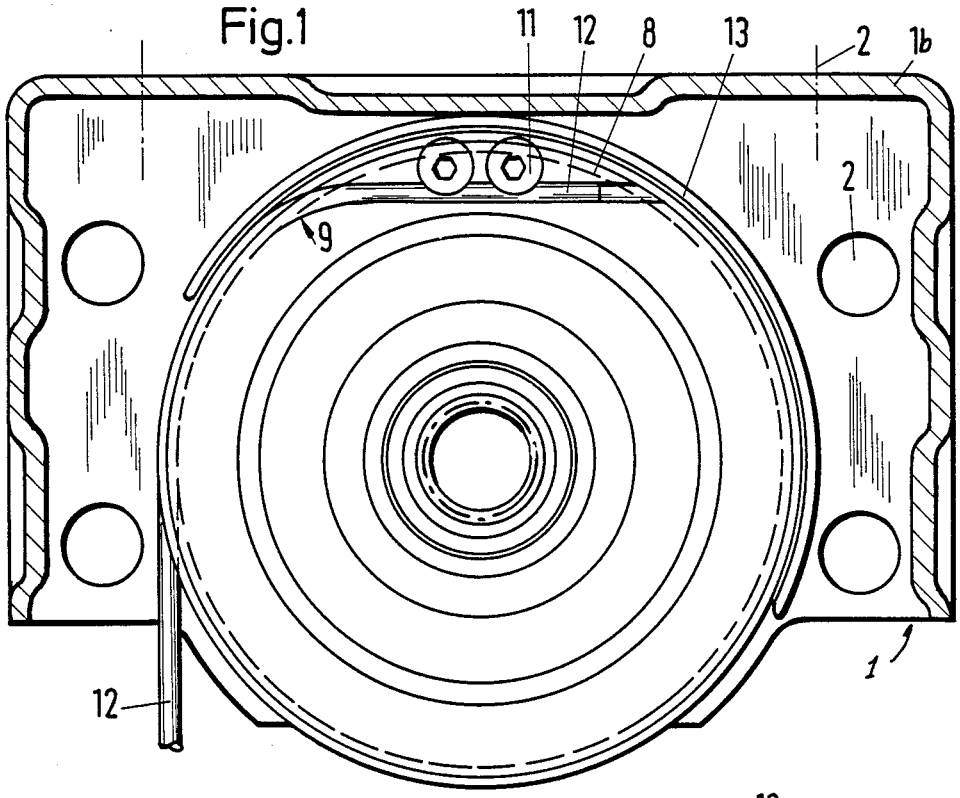
Fig. 3
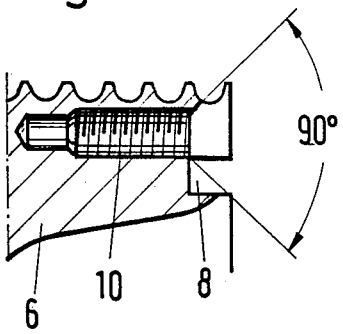
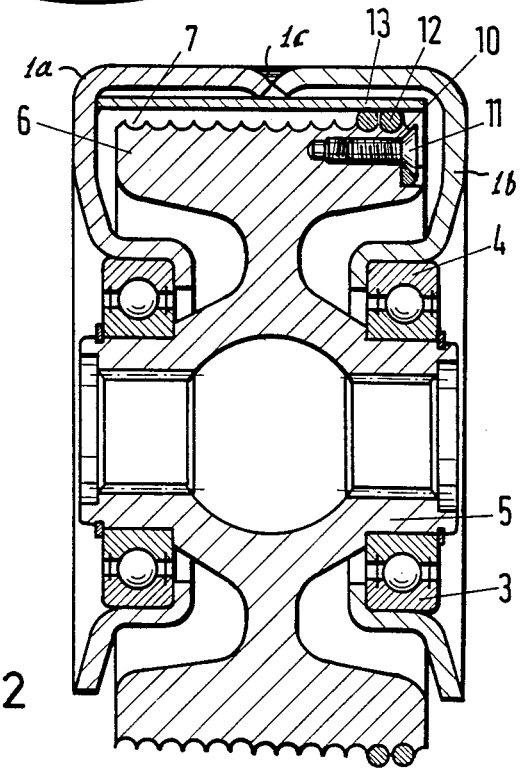
Fig. 2

Fig. 4
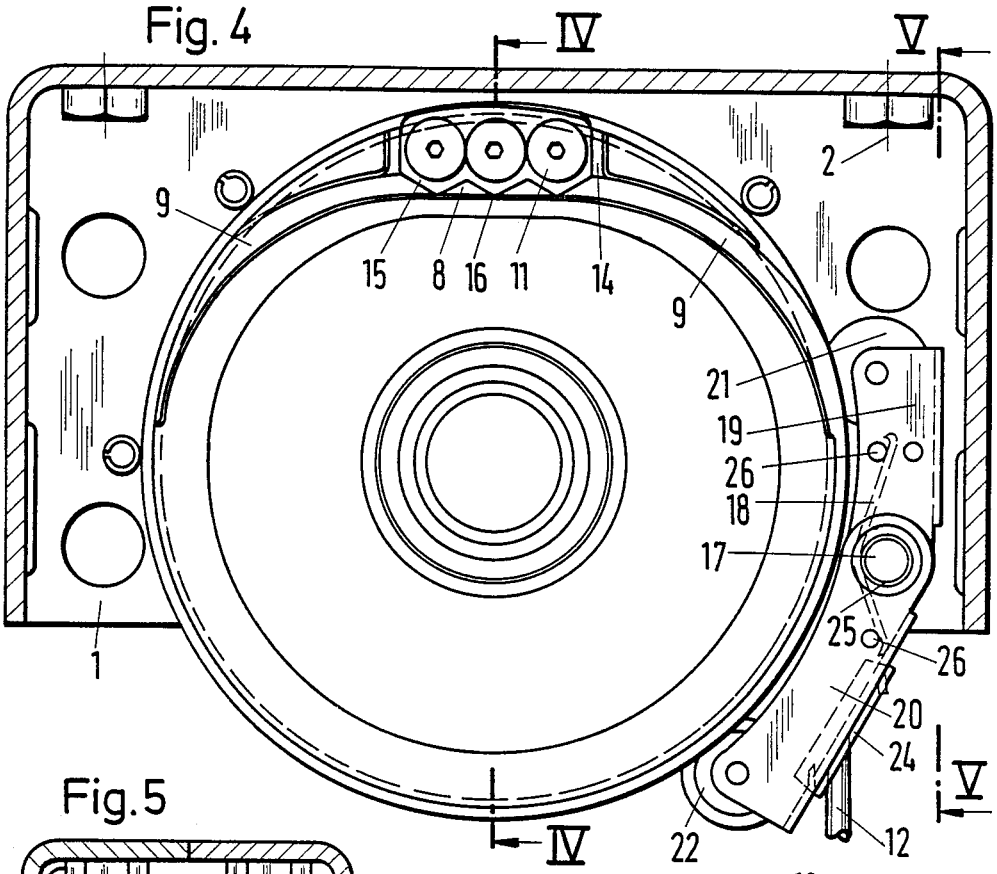
Fig.5
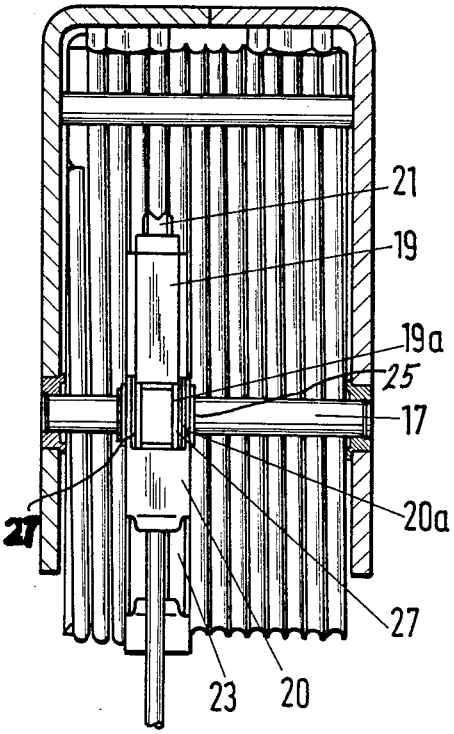
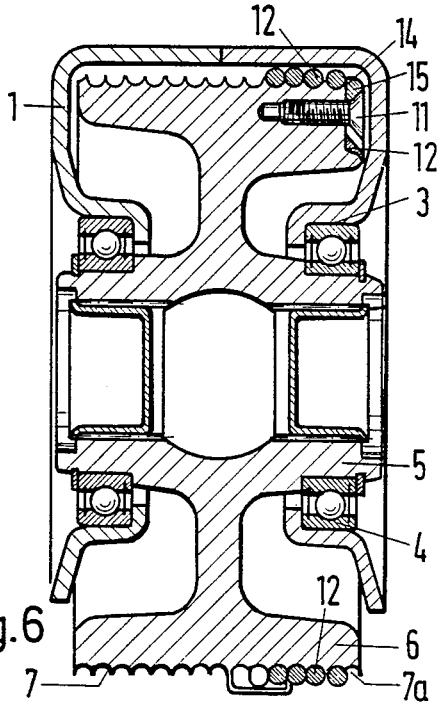
Fig.6

FASTENING A CABLE OR A DRUM

BACKGROUND OF THE INVENTION

The present invention relates to fastening a rope or cable to the front or one of the fronts of a cable drum, winchdrum, rope drum or the like, hereinafter referred to collectively as cable drum.

A cable drum of the type to which the invention pertains is for example shown in German printed and published patent application 27 18 498. Here a cable end is sharply bent off and traverses a bore in one of the front plates of the drum to reach around and through another bore into the interior thereof. A screw fastens the cable to the front plate of the drum and from the inside the cable is guided to run towards and into a peripheral groove. For purposes of fastening the cable one actually needs altogether three sharply bent portions which aspect unfortunately in the case of a steel cable reduces its use life rather drastically. Fastening of the cable to the drum in this fashion is moreover comparatively expensive. Another drawback of the known fastening method is that a particularly contoured and configured front plate is required for the drum whereby the fastening particulars are not necessary features for any other purpose as far as the drum construction is concerned. Still another drawback is that the fastening points are fairly close to the central mounting area of the drum and is, therefore, difficult to access.

DESCRIPTION OF THE INVENTION

It is an object of the present invention to provide a new and improved cable fastening to a drum which is simplified as compared to the prior art construction as outlined above, whereby particularly the complexity of the fastening procedure should be reduced.

In accordance with the preferred embodiment of the present invention it is suggested to provide the winch drum or cable drum on an end wall with a groove which through one or two curved portions merges with a peripheral groove of the winch and receives the end of the cable. At least one threaded bore for a fastening screw or screws are provided next to that front side groove. The cable will be placed into the front side groove during mounting and is then secured to the groove by means of the screw or screws.

For enhancing security in the fastening two screws may reach over the cable end in the fastening groove to hold the end securely; the screws could be e.g. dropped screws and the screw bores have threads which extend right to and along an edge of the groove. This groove is about 10% wider than the cable is thick. In a large number of tests the safety and security of this simple cable fastening was proven whereby it was found unnecessary to strengthen the cable end with solder. If necessary this could be done, but it was found to be an unnecesary and redundant precaution.

In furtherance of the invention it is suggested to provide the drum proper as a cast piece basically like a wheel and having a hub which is supported in roller bearing mounts of a casing. The casing in turn has a fastening structure for mounting the drum to a suitable carrier construction. A portion of the drum projects beyond the casing or housing, for purposes of effecting the screw connection. The housing or casing is made of two parts or shells which are peripherally interconnected. This biparted construction makes possible that the winch drum can be mounted in the casing prior to welding the housing parts together; subsequently one may fasten the cable as stated by means of the screws and in the aforementioned groove and the cable is then simply wound on the drum through turning of the drum. One half or more of the housing or casing may be provided in addition with a cable cover which extends axially over the entire drum and holds the cable in the grooves of the periphery of the drum.

Preferably the cable fastening groove will merge on both ends in curved portions and into a cable groove. The thus prepared cable drum (having just one groove at this point) can, if so desired, be provided either with a left or right hand pitch groove. The fastening will be the same for either type of the type. This feature reduces cost because one does not need different fastening drum fronts for different pitches. The cable fastening groove may be widened for an additional or supplemental rope fastening block which is urged by means of screws against the cable. That block may be provided with clamping teeth facing the cable and engaging it.

In furtherance of the invention a casing or housing for mounting the drum may be provided with a hold down device for the cable extending parallel to the drum's axis and provided for being effective on both sides. This hold down device may include two, spring biased arms one of which extends into the housing and is provided with pressure roller for the cable, while the other arm is provided with a guide roller that runs in the cable groove outside of the housing.

From an overall point of view the fastening was found to be highly economical as far as space is concerned so that the cable hold down device will not collide even if the drums capacity is used to the utmost. In order to use the same or same kind of hold down device for different pitch orientations of the groove one may provide axial spacer disks between the two arms and in a manner which is dependent on the kind of pitch.

The spring biasing of the arms is preferably attained by a leaf spring bearing with a central area against a sleeve which connected to the two arms. This spring urges the arms against the drum. A cable guide opening is provided in that arm which extends beyond the housing. That opening is lined with a plastic or synthetic material having a low friction coefficient. The cable deflection will be limited when the cable runs through that opening.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 illustrates a longitudinal section through a casing with a drum constructed in accordance with the preferred embodiment of the present invention for practicing the best mode thereof;

FIG. 2 is a cross section through the drum with casing;

FIG. 3 is a portion in FIG. 2 shown in a larger scale;

FIG. 4 is a longitudinal section through a casing with a drum still in accordance with the preferred embodiment for practicing the best mode thereof by means of a different example;

FIG. 5 is a section taken through V—V in FIG. 4; and

FIG. 6 is a section taken as indicated by VI—VI in FIG. 4.

Preceeding to the detailed description of the drawings, FIG. 1 shows a casing 1 for a cable drum 6. The casing side wall has several connection bores 2 for receiving adjusting nuts, for purposes of fastening and connecting the drum through the housing, to a suitable mounting and carrier construction which is not shown. The housing is of biparted construction, housing halves 1*a* and 1*b*, being welded along three sides (welding seam 1*c*), the bottom of the housing is open.

The respective sides of the housing parts are provided with mounting flanges for ball bearings 4 by means of which a double hub 5 of a cable drum 6 is journaled and supported. The cable drum 6 had grooves 7 along its cylindrical periphery for receiving a cable 12. The cable drum 6 itself is made of a singal piece which is actually of the type known from cranes.

The cable is clamped to one front side of the drum by means of screws 11. In particlar, a cable end is received by a straight groove in an end wall of the drum 8 and the screws 11 clamp the cable in that groove. The straight groove 8 continues in a curved portion 9 which in turn moves with the first cable drum groove 7*a*. The straight portion 8 of the groove runs along two threaded bores 10 for receiving the fastening and clamping screws 11. As shown specifically in FIG. 3 the threaded bores 10 for receiving screws 11 are in fact provided axially in the rim portion of the drum 6. Each of the bores 10 extends to the edge of the groove 8 and is provided with a 90 degree bevel for receiving the respective head of a screw 11 when inserted therein. This of course is true for both screws 11.

As shown in FIG. 2 the heads of the screws 11 urge and squeeze the end of the cable 12 into the corner of that groove which enhances security and certainty of clamping. The cable drum periphery is, from an overall point of view, covered to some extent by a cover 13 spanning a good part of the periphery of the drum. The core is provided close to the periphery of the drum so as to prevent jumping of the cable out of the respective groove 7. The cover 13 will be welded to one of the housing halves prior to welding these halves of the housing together. Prior to welding of the two housing parts 1*a*, 1*b* drum 6 has been mounted by means of a hub 5 in the bearings 4 to thereby mount the drum in the housing to be made.

For fastening the cable 12, particularly the one end thereof in groove 8, the drum is turned so that the groove 8 will project from the housing at the more or less lowest point. The screws for fastening the cable can now easily be inserted into the respective threaded bores. Next, the brum 6 is turned and thereby cable 12 wound onto it whereby one should establish at leasst two loops corresponding to safety requirements.

Proceeding now to the example shown in FIGS. 4–6, herein a cable fastening block is provided on one of the front sides of the drum. The fastening obtains also there through several screws 11 of the kind mentioned earlier. This particular block 15 is inserted in a widened portion 14 of the groove 8'. The block 15 has clamping teeth 16 facing the cable 12 and being forced against the cable. The indent or groove 8' in this case merges through two arc shaped portions 9 in respective first groove 7*a* but without having any pitch. Following this particular groove 7*a* a regular groove is left or right handed pitch will continue. Thus, initial groove 7*a* is circular and not helical, but will be continued in a helical left or a right handed groove when the drum is completed.

The casing 1 in this 17 is provided with a shaft on which rides a cable guide shown in FIGS. 4 and 5. The cable guide is provided with a final arm 19 which projects into the casing 1 and carries a pressure roller 21 for holding down the cable 12. This pressure roller 21 is configured as a roller as shown specifically in FIG. 5. The lower, second arm 20 of this two arm cable guide carries a wedge shaped guide roller 22 projecting into the groove 7. Upon turning the drum 6 the first roller, 21, causes shifting of the cable guide upon the shaft 17. The arm 20 is provided with a cable guide opening 23 through which the cable 12 may pass. This opening limits lateral deflection of the cable whereby low friction is ensured by a synthetic insert 24 having suitable low friction properties.

For urging the rollers 21 and 22 onto the drum, an spring 18 is provided as part of the cable guide. This spring bears against the shaft 17 via a sleeve 25. The ends of the leaf springs 18 bear against pins 26 on the arms 19 and 20. As also shown in FIG. 5 sleeve 25 is connected to the mounting openings 19*a* and 20*a* of the arms 19 and 20 respectively. The arm 19 is narrower than the arm 20. Between the respective openings, shims, spaces or disks are provided which can be exchanged or replaced. Owing to different positionings and through a different number of disks on both sides one matches the cable guide to the particular pitch of the grooves 7, particularly in view of the case of different cable diameters. The particular cable guide construction is applicable and usable in conjunction with different kinds of cable drums depending on pitch, diameter etc.. FIG. 5 shows a right hand cable drum pitch the configuration is of mirror symmetry of left hand pitch.

The invention is not limited to the embodiments described above but all changes and modifications thereof, not constituting departures from the spirit and scope of the invention, are intended to be included.

We claim:

1. A winch including structure for fastening a cable to an end face of a cable drum having a longitudinal axis, the drum having a helical peripheral groove and a recessed groove wall on said end face, the groove wall being perpendicular to the longitudinal axis of the drum, comprising:

a cable end receiving groove in said end face, comprising a straight groove portion and at least one curved groove portion which merges with said peripheral groove for receiving one end of the cable;

at least one axially extending fastening screw means having head means; and at least one axially extending threaded bore in said groove wall adjacent said straight groove portion, for receiving the screw means, the axial bore being positioned so that the head means of the screw means clamps the cable in the straight groove portion and against the recessed groove wall.

2. A winch as in claim 1, comprising a plurality of axially extending threaded bores adjacent said straight groove portion for receiving a plurality of said fastening screw means such that the head means of the screw means clamp the cable end in the staight groove portion and against the recessed groove wall.

3. A winch as in claim 1, the drum having a hub by means of which it is mounted in a housing, the drum projecting beyond the housing.

4. A winch as in claim 3 including a cable hold down plate secured to the housing.

5. A winch as in claim 3, including a shaft in the housing and a cable hold down device riding on the shaft.

6. A winch as in claim 5, the hold down device comprising two pivotally mounted lever arms, and spring means for biasing the lever arms toward the drum, each lever arm having a roller thereon, one roller engaging the cable and the other roller engaging the peripheral groove, under the bias of the spring means.

7. A winch as in claim 6, the spring means comprising a leaf spring, a central part of the leaf spring bearing against the shaft.

8. A winch as in claim 6, one of said lever arms extending beyond the housing and having a cable deflection limiting opening through which the cable passes.

9. A winch as in claim 1, said cable receiving groove having curved portions on both ends of the straight groove portion merging with said peripheral groove.

10. A winch as in claim 1, including a clamping block held down by the screw means and clampingly engaging the cable end in the cable receiving groove.

11. A winch as in claim 10, the block having clamping teeth engaging the cable end.

* * * * *